US007376996B2

(12) United States Patent
Landi et al.

(10) Patent No.: US 7,376,996 B2
(45) Date of Patent: May 27, 2008

(54) MULTI-SECTION MATTRESS OR MATTRESS OVERLAY AND METHOD OF MAKING SAME

(75) Inventors: Curtis L. Landi, San Jose, CA (US); Susan Wilson, San Jose, CA (US)

(73) Assignee: Supracor, Inc., San Jose, CA (US)

( * ) Notice: Subject to any disclaimer, the term of this patent is extended or adjusted under 35 U.S.C. 154(b) by 252 days.

(21) Appl. No.: 11/156,246

(22) Filed: Jun. 17, 2005

(65) Prior Publication Data

US 2005/0278860 A1 Dec. 22, 2005

Related U.S. Application Data

(60) Provisional application No. 60/581,826, filed on Jun. 21, 2004.

(51) Int. Cl.
*A47C 27/00* (2006.01)
*B32B 3/12* (2006.01)

(52) U.S. Cl. ..... 5/722; 5/723; 5/691; 5/932

(58) Field of Classification Search ..... 5/722–726, 5/932, 690, 691, 417, 420, 644, 706–715, 5/652–654, 655.3, 630, 640, 632–634, 645, 5/652.1, 652.2

See application file for complete search history.

(56) References Cited

U.S. PATENT DOCUMENTS 1,830,570 A * 11/1931 Smith et al. ..... 267/117
2,623,574 A * 12/1952 Damsch ..... 297/111
2,843,181 A * 7/1958 Paschen ..... 297/114
3,253,861 A * 5/1966 Howard ..... 297/452.43
3,606,623 A * 9/1971 Aymar et al. ..... 5/660
3,736,027 A * 5/1973 Stafford ..... 297/452.43
4,207,633 A * 6/1980 Smith et al. ..... 5/632

(Continued)

FOREIGN PATENT DOCUMENTS

EP 1258344 11/2002

(Continued)

*Primary Examiner*—Robert G Santos
(74) *Attorney, Agent, or Firm*—Buchanan, Ingersoll & Rooney LLP

(57) ABSTRACT

A multi-section mattress or mattress overlay including a first generally rectangular section made from a first honeycomb core having a first core face and a second core face, the first core having a first facing sheet bonded to one of the first and second core faces, a second generally rectangular section made from a second honeycomb core having a third core face and a fourth core face, the second core having a second facing sheet bonded to one of the third and fourth core faces, the second section being positioned with one side thereof immediately adjacent an opposing side of the first section; and a seam joining the first and second sections together along the lengths of the one side and the opposing side, the seam being formed by bonding a portion of the first face extending along the one side to a portion of the third face extending along the opposing side, and by orienting the bonded portions of the first and third faces such that they extend away from a plane including the first and third faces and toward a plane including the second and fourth faces.

20 Claims, 7 Drawing Sheets

U.S. PATENT DOCUMENTS 4,518,203 A * 5/1985 White ..... 297/452.16
4,836,605 A * 6/1989 Greenwood et al. ..... 297/250.1
4,843,664 A 7/1989 Farnworth et al.
4,905,332 A * 3/1990 Wang ..... 5/655.3
5,001,792 A * 3/1991 Strobel ..... 5/675
5,086,529 A * 2/1992 DeGroot ..... 5/710
5,444,881 A * 8/1995 Landi et al. ..... 5/708
5,617,595 A * 4/1997 Landi et al. ..... 5/653
5,678,266 A * 10/1997 Petringa et al. ..... 5/655.5
5,701,621 A 12/1997 Landi et al.
5,915,556 A * 6/1999 Simpson ..... 206/461
6,042,186 A * 3/2000 Kojic et al. ..... 297/452.41
6,122,785 A * 9/2000 Bondie et al. ..... 5/709
6,321,401 B1 * 11/2001 Fleming et al. ..... 5/420
6,568,005 B2 * 5/2003 Fleming et al. ..... 5/420
6,754,920 B2 * 6/2004 Fleming et al. ..... 5/420
6,886,204 B2 * 5/2005 Kasatshko et al. ..... 5/722
6,990,696 B2 * 1/2006 Stewart et al. ..... 5/413 R
7,051,386 B2 * 5/2006 Stewart et al. ..... 5/413 R
7,231,681 B2 * 6/2007 Kasatshko et al. ..... 5/722
2005/0099054 A1 * 5/2005 McCarthy et al. ..... 297/452.41
2005/0278860 A1 * 12/2005 Landi et al. ..... 5/690
2005/0278861 A1 * 12/2005 Kasatshko ..... 5/713
2006/0123542 A1 * 6/2006 Wilson et al. ..... 5/400

FOREIGN PATENT DOCUMENTS

WO WO95/00052 1/1995

* cited by examiner

MULTI-SECTION MATTRESS OR MATTRESS OVERLAY AND METHOD OF MAKING SAME

The present application claims priority under 35 U.S.C. 119(e) to U.S. Provisional Patent Application Ser. No. 60/581,826 filed Jun. 21, 2004, which is incorporated herein by reference in its entirety.

BACKGROUND TO THE INVENTION

1. Field of the Invention

This invention relates generally to mattresses and mattress overlays and more particularly to an apparatus and method for making a segmented or multi-sectioned mattress or overlay using a honeycomb core.

2. Description of the Prior Art

Foam and gel-filled materials have long been used in mattresses and cushions to absorb shock and provide support for various parts of the human body. More recently, honeycomb cores have been used to provide improved support characteristics for such applications. However, either the inherent characteristics of these materials or the methods used to form the pads have resulted in less than optimum configurations for applications in which the pads must be folded, must have different support characteristics across their surface, or are intended to accommodate multiple users.

For the case in which the mattress must be folded either in use or for storage, unless the pad is segmented and seamed together, its thickness prevents folding and it usually must be rolled. On the other hand if the pad is segmented to accommodate storage, the junctions of the segments present seams or spaces that interfere with uniform support during use.

For example, some mattresses and seat cushions include one or more sections of foam material encased within a covering, with the foam being configured and formed to provide comfortable supporting surfaces. Where multiple foam cushions are combined in a single unit, the unit must rely on the integrity of the casing to hold the cushions in their intended relative positions. This usually requires that the cushions be placed in individual pockets separated by a seam of some type that normally makes it difficult to prevent unwanted separations between adjacent cushion parts. If a plastic casing is used, the separation problem is usually worse due to the type of bonding seam that is normally used. There are also other shortcomings associated with the use of foam materials. For example, foam is susceptible to taking a compression set after many periods of use wherein the foam cells collapse and the support benefit of the cushion is lost.

In other prior art mattresses and cushions, a gel or other fluid-like substance is used to fill an impermeable sack which is disposed within or on a foam envelope. The entire assembly is encased within a moisture resistant cloth, vinyl and/or urethane, or waterproof covering and placed on a seat or mattress support. In some cases the gel-filled cushion is formed with contours or contact-free zones to relieve contact and pressure on sensitive portions of the user's body. U.S. Pat. No. 5,201,780 (Dinsmoor, III et al.) discloses a tri-layered mattress pad that includes a cover or casing containing an interior strata of a plastic film layer atop a fluid bladder layer supported on a foam layer. This pad cannot be folded due to its complicated internal construction.

Other prior art mattresses that include a matrix of air or fluid cells that may be inflated and deflated to more evenly support body parts, although flexible enough to be bent or folded, usually include complicated plumbing components and in addition to the fluid supply components (e.g. compressor, valving, tubing, etc.), a computer is often needed to constantly measure and control the reaction of each air cell to pressure and load changes by varying the deflation and inflation in each cell. Thus, such mattresses are also costly and complicated.

Honeycomb structures are now often selected as the preferred padding for use in mattresses and other cushions intended to support a human body. For example, Landi et al U.S. Pat. No. 5,701,621 disclose various improved mattress and mattress pad configurations made from one or more layers of single panel, flexible elastomeric honeycomb core encased within a covering fabricated from a porous or fabric material. The honeycomb core in one disclosed embodiment is faced on the bottom side with a plastic facing sheet having a plurality of perforations to permit expulsion of moisture from the core. In another embodiment, the mattress pad includes facing sheets attached to both the upper and lower surfaces of a single core. A covering encases both the core and facing sheets. The honeycomb core of this embodiment may include cell walls having perforations formed therein so that each cell of the core can communicate with a pumping subsystem to allow control of the firmness of the pad.

Another Landi et al embodiment includes two honeycomb core panels disposed one atop the other with both cores being encased within a single covering that may be permeable or may be constructed with side openings or vents that are impervious to gas and fluids. The cell walls of each core may be solid, i.e. non-perforated, or some or all of the cell walls of the cores may include a plurality of perforations. In still another embodiment, a dual core pad having three facing sheets is disclosed wherein each facing sheet is solid, i.e. non-perforated, or may be formed with a plurality of perforations. The facing sheets are respectively bonded to the upper surface of the upper core, the lower surface of the upper core and the adjacent upper surface of the lower core, and the bottom surface of the lower core. The facing sheets may be solid, i.e. non-perforated or may be formed with a plurality of perforations.

Although providing substantial improvement over the previous materials, each of these honeycomb embodiments is constructed of single core layers and is thus not ideally suited for applications in which folding is required, in which substantial non-planer orientation or support is contemplated, in which support of more than one human body is intended to be accommodated, or in which different anatomical support characteristics are to be had in different areas of a single mattress or mattress overlay.

There thus remains a need to provide a method of making an improved mattress or mattress overlay that overcomes the above stated deficiencies and maximizes comfort, durability, shape maintainability, storability and utility, yet does not possess the shortcomings of the prior art.

OBJECTS OF THIS INVENTION

It is therefore an object of the present invention to provide an improved mattress or mattress overlay that is suited for applications in which folding is required either for storage or during use.

Another object of the present invention to provide an improved mattress or mattress overlay that is suited for applications in which substantial non-planer orientation or support is contemplated.

Still another object of the present invention to provide an improved mattress or mattress overlay that is suited for applications in which support of more than one human body is intended to be accommodated Yet another object of the present invention to provide an improved mattress or mattress overlay that is suited for applications in which different anatomical support characteristics are to be had in different areas of a single mattress or mattress overlay.

A further object of the present invention is to provide an improved mattress or mattress overlay having multiple segments or sections that are closely joined together so as not to present seams or spaces therebetween which will interfere with use of the pad.

SUMMARY OF THE INVENTION

Briefly, a multi-section mattress or mattress overlay in accordance with a presently preferred embodiment of the present invention includes a first generally rectangular section made from a first honeycomb core formed of undulated strips of resilient thermoplastic material thermal compression bonded together and expanded to form cell walls defining a first plurality of contiguous regularly shaped cells extending between a first face of the first core and a second face of the first core, the first core having a first facing sheet bonded to at least one of the first and second core faces; a second generally rectangular section made from a second honeycomb core formed of undulated strips of resilient thermoplastic material, thermal compression bonded together and expanded to form cell walls defining a second plurality of contiguous regularly shaped cells extending between a third face of the second core and a fourth face of the second core, the second core having at least a second facing sheet bonded to one of the third and fourth core faces, the second section being positioned with one side thereof immediately adjacent an opposing side of the first section; and means forming a seam joining the first and second sections together along the length of the opposing sides, such seam being formed by bonding a portion of the first face along the one side to a portion of the third face along the opposing side and orienting the bonded portions such that they extend away from a plane including the first and third faces and toward a plane including the second and fourth faces.

Implementations of the invention can realize one or more of the following advantages. The technique for seaming together one or more honeycomb sections facilitates the manufacture of relatively large mattresses or mattress overlays formed from the honeycomb sections. If during manufacture a flaw in one section occurs rendering the section defective or otherwise not worthy of commercial sale, the section can be replaced. Because each section is smaller than the resulting multi-sectioned mattress or mattress overlay, discarding one section due to a manufacturing defect is less expensive than discarding an entire mattress or mattress overlay.

Seams in a mattress or mattress overlay formed from one or more sections facilitate folding the mattress or mattress overlay along the seams. For example, a futon style mattress formed from three sections can be folded in three parts along two seams joining the three sections, thereby allowing for easy storage.

The one or more sections forming a mattress or mattress overlay can be strategically sized, such that the seams are positioned in areas that are typically in lower pressure zones of the mattress or mattress overlay; for example, where a user's lumbar region may lie, or knee region, as compared to a higher pressure zone such as where a user's shoulder blades or buttocks contact the mattress. This strategic placement of the seams reduces the likelihood of the seams being felt by the user. Additionally, the configuration of the seams is such that the likelihood of them being felt by the user, or discomforting to a user, is reduced in any event.

A mattress can be formed from two or more sections, where one or all of the sections have different relative stiffnesses, lengths or widths. For example, a mattress can be formed having one side of a lower stiffness or width than the other to accommodate preferences of two users of the mattress.

An important advantage of the present invention is that multiple thermoplastic honeycomb panels may be configured and joined within an array to customize and individually tailor a mattress or mattress overlay to suit a particular user application.

Another advantage of the present invention is that the mattress or mattress overlay can be configured to support and conform to a wide range of user requirements and applications.

Still another advantage of the present invention is that the mattress or overlay may be constructed from a perforated core honeycomb panel that is breathable to allow perspiration removal and cooling of the user.

Another advantage of the present invention is that different thermoplastic honeycomb core designs or multiple panels of different thermoplastic honeycomb core designs may be utilized to maximize design flexibility of the mattress or overlay.

These and other objects and advantages of the present invention will no doubt become apparent to those skilled in the art after having read the following detailed description of the preferred embodiments which are described herein and illustrated in the various figures of the drawing.

DESCRIPTION OF THE DRAWINGS

Like reference symbols in the various drawings indicate like elements.

DETAILED DESCRIPTION

A mattress or mattress overlay in accordance with the present invention can be formed from one or more sections or panels joined together with one or more seams along the length of a side or sides of the sections. Preferably, each section is made from a honeycomb core, and a face sheet can be bonded to one or both outer surfaces of the honeycomb core. The honeycomb core can be formed of undulated strips of resilient thermoplastic material, thermal compression bonded together and expanded to form cell walls defining a plurality of contiguous regularly shaped cells. An exemplary honeycomb core and facing sheet assembly is described in U.S. Pat. No. 5,039,567, issued on Aug. 13, 1991 to Landi et al., entitled "Resilient Panel Having Anisotropic Flexing Characteristics and Method of Making Same" and incorporated hereinto by reference. Another exemplary honeycomb core and facing sheet assembly is described in U.S. Pat. No. 5,701,621, issued on Dec. 30, 1997 to Landi et al., entitled "Liner for Overlaying a Mattress" and incorporated hereinto by reference.

The cell walls and/or the one or more facing sheets can be perforated for improved air circulation. For example, the perforated cell walls and/or facing sheets can be formed as described in U.S. Pat. No. 5,180,619, issued Jan. 19, 1993 to Landi et al., entitled "Perforated Honeycomb" and incorporated hereinto by reference.

Two adjacent sections of a honeycomb core or a honeycomb core/facing sheet assembly are joined together with a seam, where the seam is formed on an underside of the mattress or mattress overlay, i.e., away from an upper or sleeping surface. On the upper or sleeping surface, the seam may or may not create a slight depression. A mattress overlay is typically thinner than a mattress, and is configured to lie on top of a mattress, e.g., a conventional spring mattress, and may be secured with straps, self adhering fastening strips or pads or the like. The mattress overlay provides additional comfort and support to the user.

Figure 1:
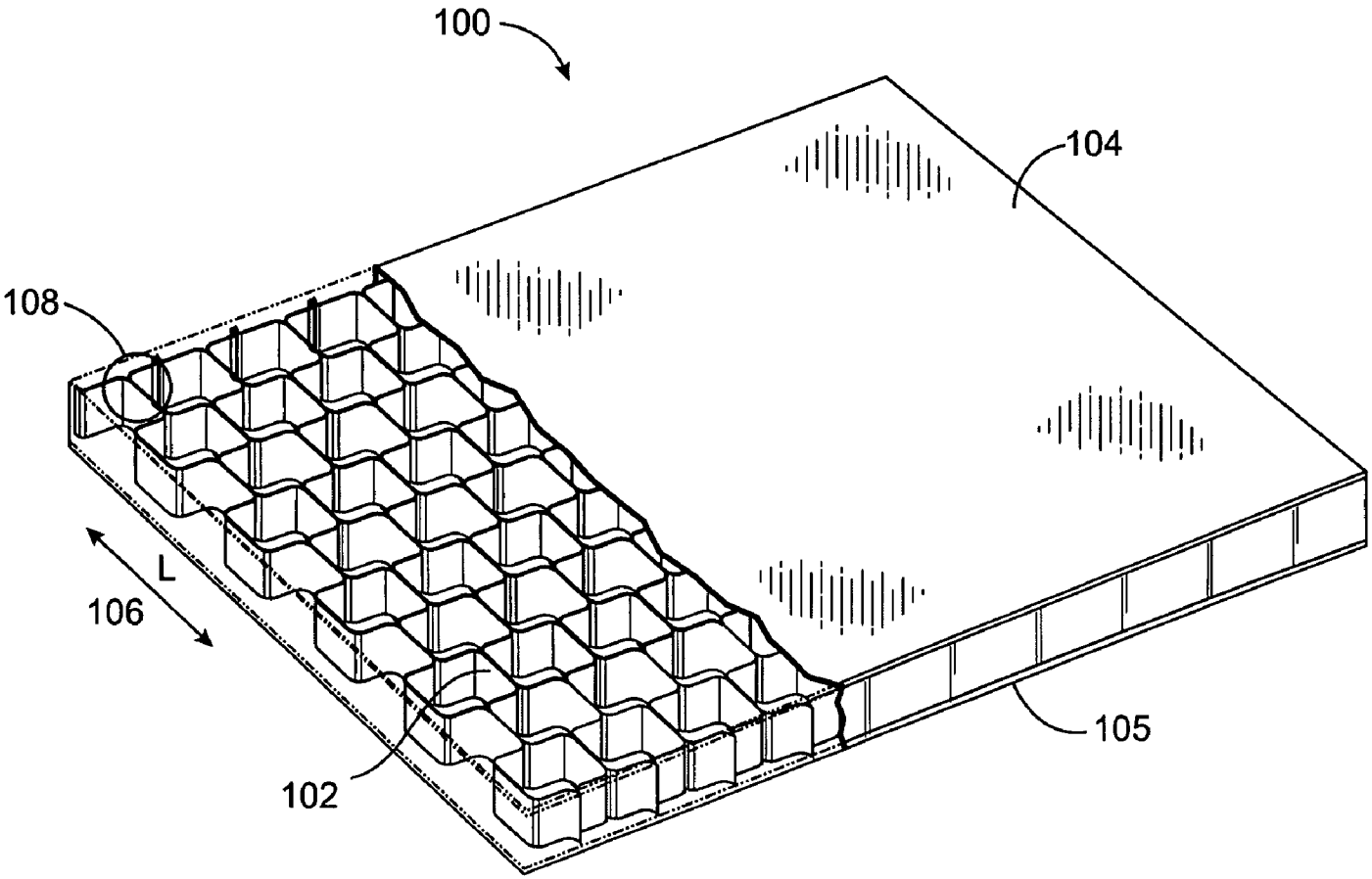
FIG. 1 (PRIOR ART)
FIG. 1 is a partially broken perspective representation of a section of a prior art mattress or mattress liner.

Referring now to FIG. 1 of the drawing, an embodiment of a mattress or overlay section formed of a prior art honeycomb core 102 and a pair of facing sheets 104, 105 is shown generally at 100. The technique for forming the honeycomb (e.g., as described in the above referenced Landi et al patents) creates cell walls with double thickness in at least one direction, referred to as the "L" direction, described further in pending U.S. patent application Ser. No. 10/761,930, of Landi et al., filed Jan. 20, 2004, entitled "Multi-Layer Honeycomb Sole" and incorporated hereinto by reference. In the illustrated section 100, the L direction is indicated by arrow 106. Region 108 shows an example of double thickness cell walls in the L direction.

In FIGS. 2A-F, a technique for joining two sections shown generally at 200 and 210, and that are similar in form to the section 100 shown in FIG. 1, except that only single facing sheets 204, 214 are illustrated. Specifically, the exemplary sections 200 and 210 each include a honeycomb core 202 and 212 and a facing sheet 204 and 214 on a lower or bottom surface of the honeycomb cores 202, 212. The upper surfaces 206, 216 of the honeycomb cores 202, 212 are bare; that is to say, unfaced. These surfaces may however be faced with the same or different type of material used for the facing sheets 204, 214. The upper surfaces 206, 216 may have been planarized, for example, using techniques described in the above-referenced U.S. Patents, such that the upper surfaces 206, 216, which form the sleeping surface of the mattress or mattress overlay, are smooth.

Figure 2A:
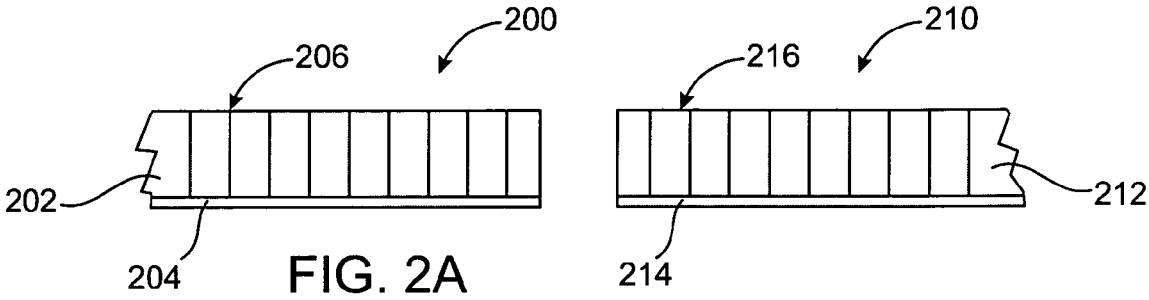
FIGS. 2A-E are schematic elevational representations illustrating two sections of a multi-section mattress or mattress liner being joined together.
Figure 2B:
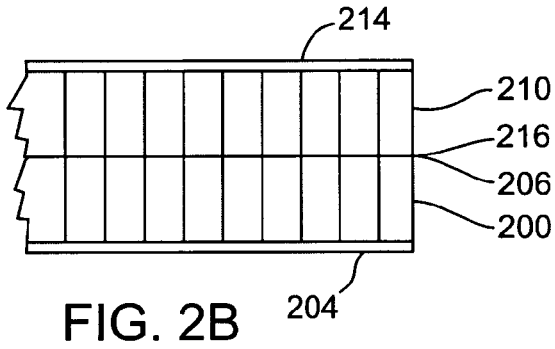
Figure 2C:
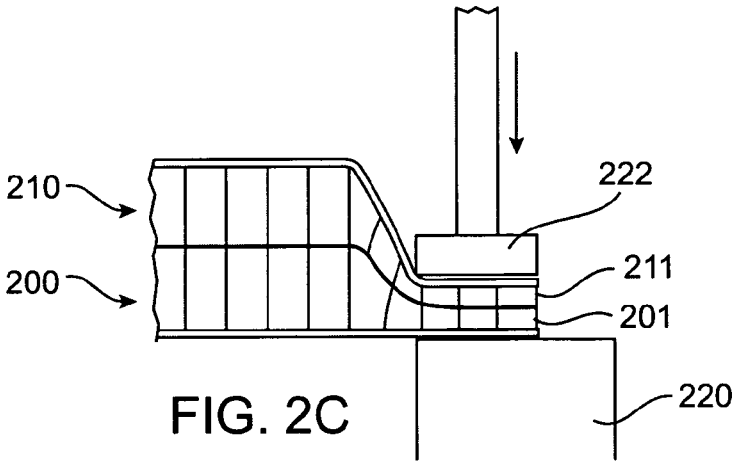

Referring to FIG. 2B, the two sections 200, 210 are placed such that their respective upper surfaces 206, 216 are in contact. In FIG. 2C, the contacting pair of sections 200, 210 are positioned on a base 220 of a radio frequency sealing apparatus, and a radio frequency sealing bar 222 is pressed downwardly onto an edge portion of the pair of sections 200, 210 to be joined. The radio frequency sealing bar 222 compresses the outer portions 201, 211 of the sections 200, 210; for example, an area along the side of each section 200, 210 including approximately 3 to 5 rows of cells. An electric current at a radio frequency is then transmitted through the sealing bar 222 causing the sections 200, 210 to be quickly heated and fused to one another.

Figure 2D:
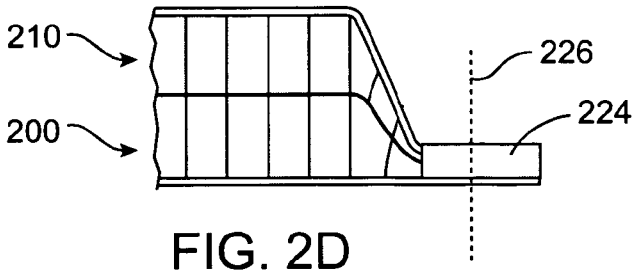

As shown in FIG. 2D, once the radio frequency sealing operation is complete, a melt sealed flange 224 is created that bonds the two sections 200, 210 together along an edge. The melt sealed flange 224 is similar to a seam allowance created when sewing two pieces of fabric together using a sewing machine. As suggested above, the melt sealed flange 224 can subsequently be trimmed back, for example, by trimming at the dashed line 226, so long as the bond between the sections 200, 210 is adequately maintained.

Figure 2E:
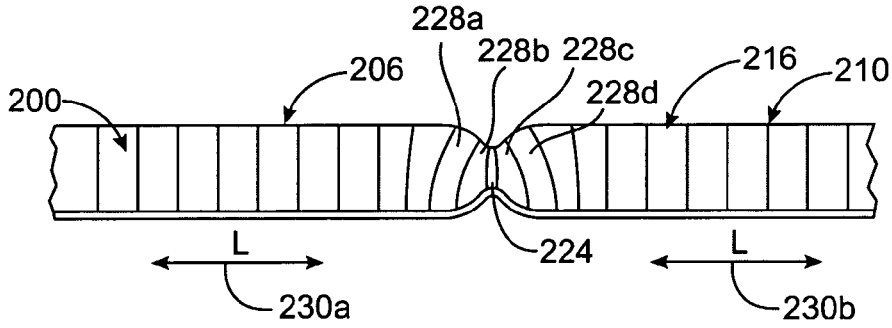

Referring to FIG. 2E, an elevational view of the two joined sections 200, 210 is shown with the section 210 rotated away from its prior position atop section 200 and into a position coplanar with section 200. Following the rotation, it will be appreciated that the trimmed melt sealed flange 224 is now extended downwardly relative to its prior disposition and is sandwiched between the two sections 200, 210. The flange is thus not visible from above the upper surfaces 206, 216.

The walls of the cells in each of the two sections 200, 210 in the vicinity of the seam, such as cells 228*a-d,* are stretched by the seam, and are therefore in tension. The tension in these cell walls can operate to urge the sections 200, 210 together along the seam, thereby further reducing any depression formed on the upper surface of the mattress or mattress overlay formed from the joined sections 200, 210.

In one implementation, the sections 200, 210 can be joined such that the L direction of each section is along the arrows 230*a* and 230*b* shown in FIG. 2E. Alternatively, the L direction can be in a direction perpendicular to the arrows 230*a* and 230*b*. In another alternative, the L direction of section 200 can be perpendicular to the L direction of section 210.

Figure 2F:
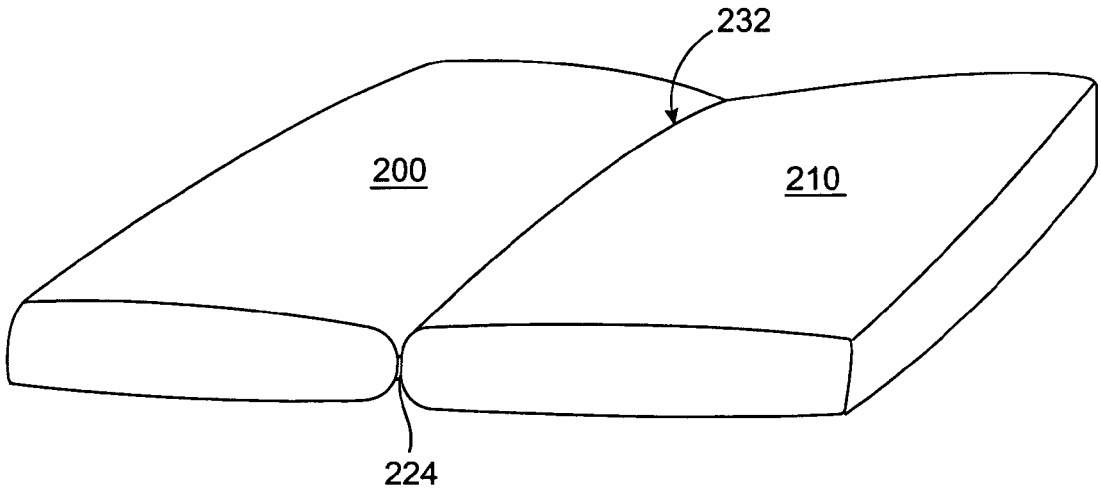
FIG. 2F is a perspective representation illustrating the two sections of FIGS. 2A-2E joined together.

FIG. 2F depicts a perspective view of a mattress or mattress overlay formed from the two sections 200, 210. The seam may create a slight depression 232 on the sleeping surface of the mattress. However, as described above, the tension in the cell walls along the seam urges the sections 200, 210 toward one another, tending to create a flatter sleeping surface. The trimmed melt sealed flange 224 is on the underside, and therefore the non-sleeping side, of the mattress.

The technique for joining the sections 200, 210 described above used radio frequency joining, however, other joining techniques can be used, for example, a heat transfer joining technique, a chemical melting/bonding technique, a stitching method or other convenient attachment methods can be used to create the seam as described.

Figure 3:
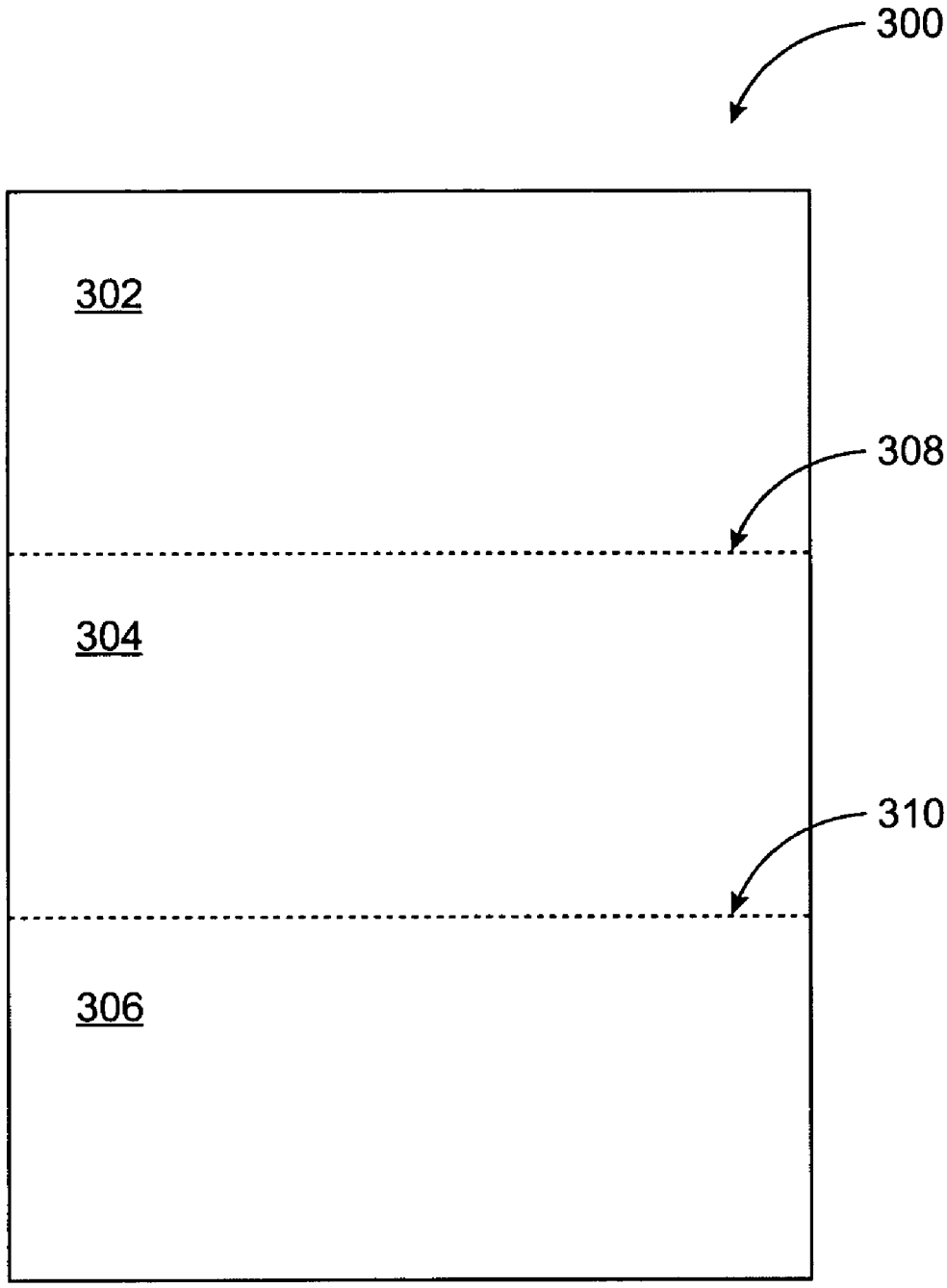
FIG. 3 is a schematic representation of a plan or top view of a mattress formed from three sections.

Referring now to FIG. 3, a schematic diagram suggests that a mattress 300 (or mattress overlay) can be formed from three rectangular sections 302, 304, 306, joined together to create two seams 308, 310 running across the width of the mattress 300. In this embodiment, the size (and number) of the sections 302-306 can be decided so that the placements of the seams 308, 310 are in areas of low pressure when a user is lying on the mattress 300. For example, the seam 308 can be placed so as to fall in the lumbar region of a user's back, i.e., the small of the back, which typically is a low pressure area, as compared to the shoulder blade area above the lumbar region, and the buttock region below the lumbar region. The lower seam 310 can be placed so as to fall in the knee region of a user's legs, which is also typically a low pressure area, as compared to the feet region, for example.

In another embodiment, different types of honeycomb core materials can be used for one or all of the three sections 302-306 forming the mattress 300. For example, as described in the above referenced U.S. Patents, by varying the size and configuration of the cells in the honeycomb core as well as the material used to form the core, the relative stiffness of the honeycomb core can vary. A user may find it desirable to have a stiffer section where the user's head lies and a less stiff section in the lower two sections. As such, the sections 302-306 can be formed using different honeycomb core configurations joined together, for example, as described in FIGS. 2A-2F above, thereby creating a mattress 300 with regions of varying stiffness.

Figure 4:
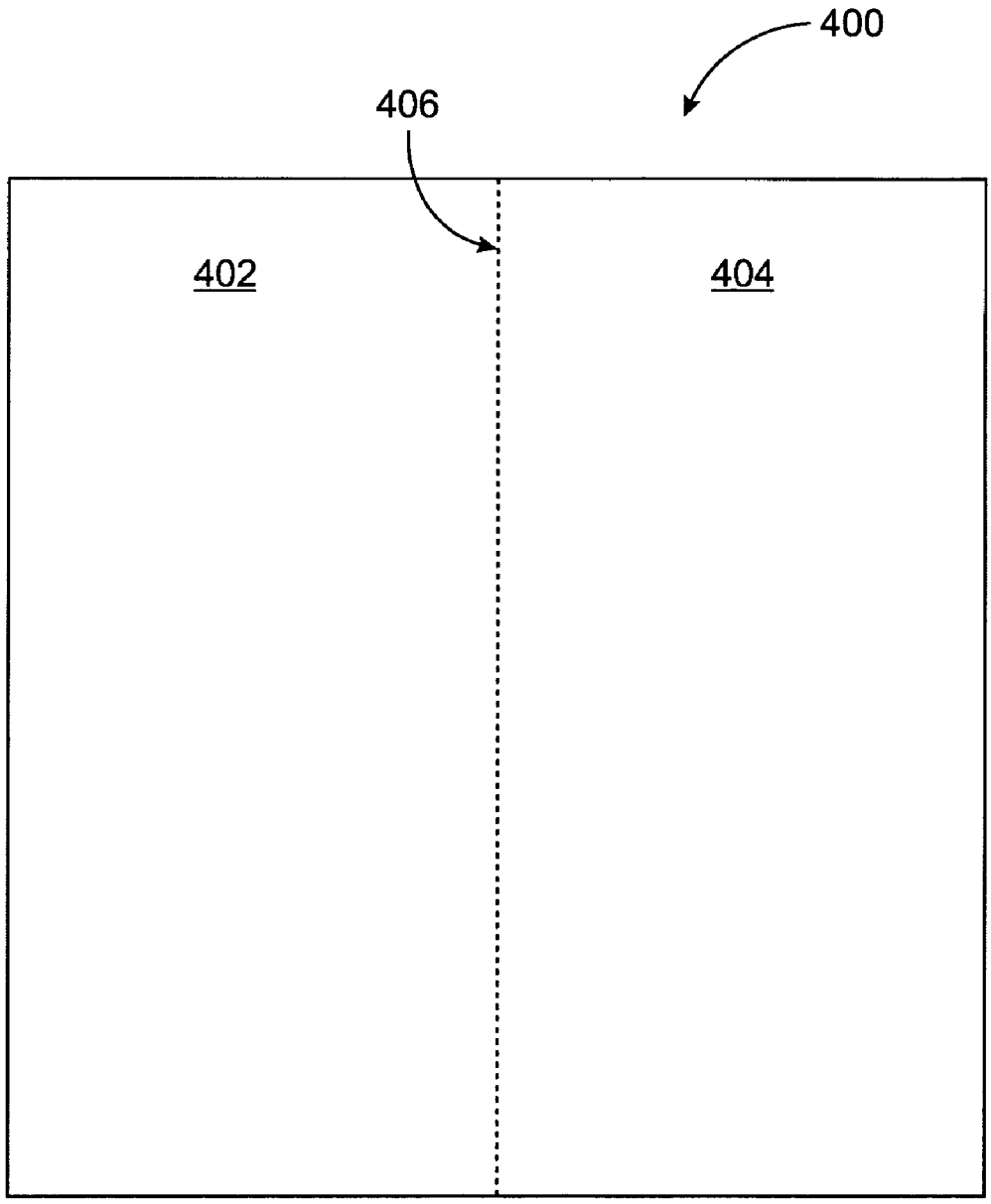
FIG. 4 is a schematic representation of a plan or top view of a mattress formed from two sections.

In FIG. 4, another embodiment of a mattress (or mattress liner) is schematically depicted at 400 formed from two elongated sections 402, 404 that are joined by a seam 406 running the length of the mattress 400. In this embodiment, each section 402, 404 can be formed from the same or different types of honeycomb core material, as described above in reference to FIG. 3. For example, one side of the mattress 400 might be made of a relatively greater (or lesser) stiffness than the other side to accommodate the preferences of two users of the mattress 400. Similarly, one of the side sections may also be made wider (or narrower) than the other to accommodate users of substantially different physical size.

In yet another embodiment, the mattress can be formed from sections divided laterally and along the length, such as a combination of the mattresses 300 and 400 shown in FIGS. 3 and 4, so that the mattress can be foldable along the lateral seams and still include longitudinal sides of differing stiffnesses. These are of course only exemplary embodiments, and it should be understood that any number of sections of any different configuration can be used.

Figure 5:
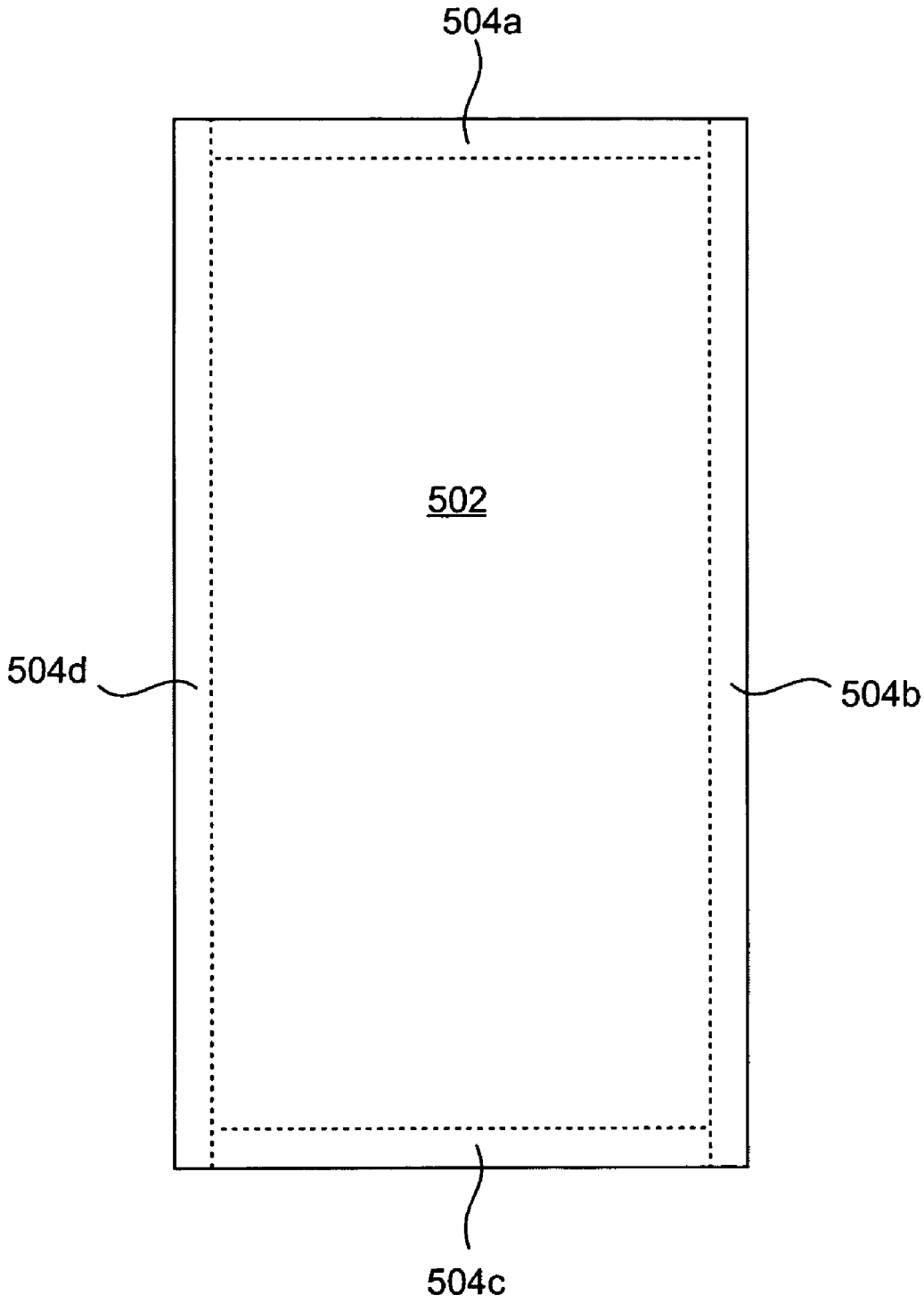
FIG. 5 is a schematic representation of a plan or top view of a mattress formed having an inner region and a circumscribing outer region.

In FIG. 5, still another embodiment is suggested wherein a mattress 500 (or mattress liner) can be formed to create an inner region 502 and an outer region 504, with the respective regions being formed using different types of honeycomb core material. For example, the inner region 502 might be formed using a honeycomb core material that is relatively less stiff than the outer region 504. The greater stiffness of the outer region 504 can thus have a bolster effect, in that a user is less likely to roll off of the mattress 500, due to a compression resistance or barrier effect created along the outer region 504 by the greater stiffness. This can be particularly advantageous for use in mattresses or mattress liners designed for infants or small children, or for use in hospitals. In the exemplary mattress 500 shown, the inner region 502 is one section, and the outer region 504 is actually made from four separate sections 504*a-d* that are all joined to the section forming the inner region 502 and to each other as appropriate. Joining techniques described above can be used.

Figure 6:
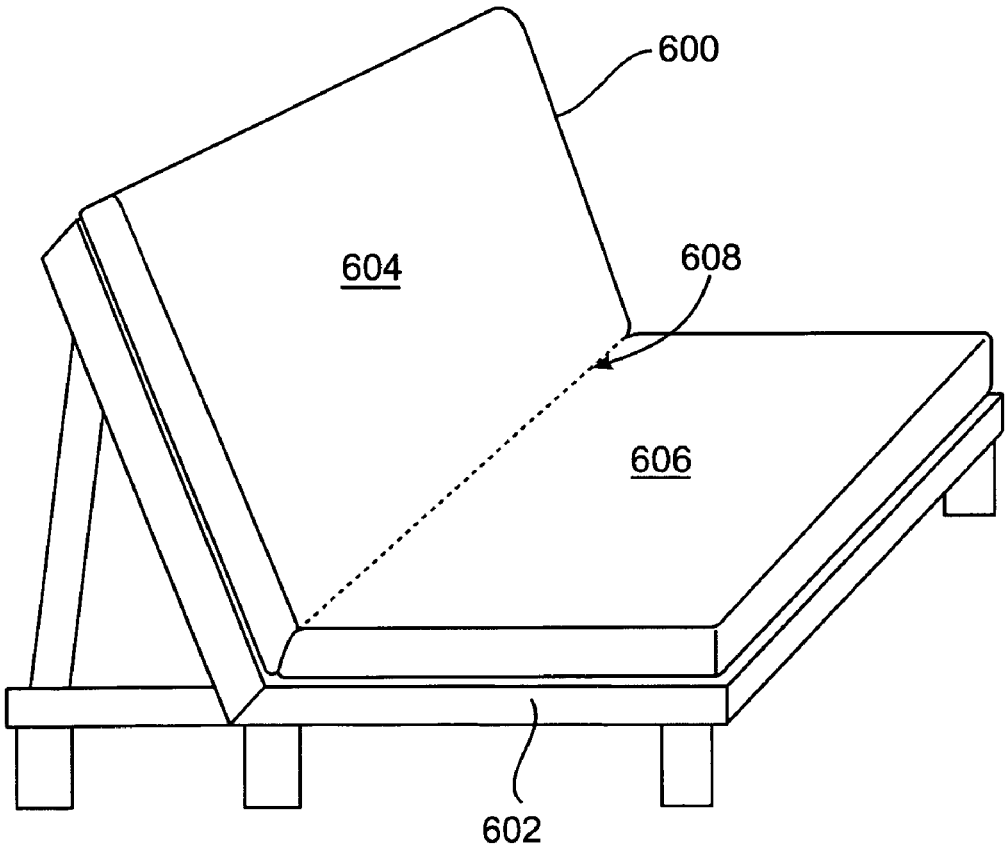
FIG. 6 is a perspective view of a futon mattress formed from two sections on a frame.

FIG. 6 illustrates application of an embodiment of the present invention as a futon mattress 600 shown positioned on a frame 602. The frame 602 can be movable from the sitting position shown to a reclining position (not shown) for sleeping. The mattress 600 may be formed from a first section 604 and a second section 606 joined together by a seam 608 placed so that when the frame 603 is in the sitting position, the mattress 600 folds along the seam 608, thereby facilitating folding and maintaining the mattress in the desired folded position. The mattress 600 is one example of strategic seam placement to accommodate other potential uses and/or configurations of the mattress 600.

In the example of joining two sections 200, 210 described above in reference to FIGS. 2A-F, each section was relatively flat, included a facing sheet on only one side of the honeycomb core, and was formed from a single layer of honeycomb core material. In other embodiments, the sections can include either no facing sheets, or can include facing sheets on both sides of the honeycomb core. It is to be understood however that one or more of the sections used to create a mattress can be formed to have a shaped contour, i.e., a non-flat section, for example, using forming techniques described in U.S. patent application Ser. No. 10/761,930, referred to above. Furthermore, one or more of the sections can be formed from two or more layers of honeycomb core material, which layers may be the same or different than one another, for example, as described in U.S. Pat. No. 5,701,621, referred to above. Moreover, one or more of the sections can be rectangular as shown in the above referenced figures, or can be formed from other shapes, including polygons or shapes having curved boundaries.

As a specific example, a mattress can be formed from two or more sections using a core material of thermoplastic urethane having: an approximately 0.005 inch gauge, an approximately 80A durometer measure, an approximately 2.5 inch thickness and an approximate ⅜ of an inch cell width. The mattress can further include a facing material (on one or both sides) of thermoplastic urethane having an approximately 0.020 inch gauge and an approximately 85A durometer measure.

The U.S. Patents and pending U.S. Patent Application referenced hereinabove are expressly incorporated by reference in their entirety into and are intended to form part of the disclosure of this application.

A number of embodiments of the present invention have been described above. Nevertheless, it will be understood that various other combinations and modifications may be made without departing from the spirit and scope of the invention. Accordingly, it is intended that the following claims be interpreted as covering all embodiments falling within the scope of the invention.

The invention claimed is:

1. A multi-section mattress overlay, comprising:

a first generally rectangular section made from a first honeycomb core formed of undulated strips of resilient thermoplastic material, thermal compression bonded together and expanded to form cell walls defining a first plurality of contiguous regularly shaped cells extending between a first core face of the first core and a second core face of the first core, a first facing sheet bonded to at least one of said first and second core faces;

a second generally rectangular section made from a second honeycomb core formed of undulated strips of resilient thermoplastic material, thermal compression bonded together and expanded to form cell walls defining a second plurality of contiguous regularly shaped cells extending between a third core face of the second core and a fourth core face of the second core, a second facing sheet bonded to at least one of said third and fourth core faces, said second section being positioned with one side thereof immediately adjacent an opposing side of said first section; and means forming a seam joining said first and second sections together along the entire lengths of said one side and said opposing side, said seam being formed by bonding a planar portion of said first face extending along said one side to a portion of said third face extending along said opposing side in a stacked relationship, and by orienting the bonded portions of said first and third faces such that they extend away from a plane including said first and third faces and toward a plane including said second and fourth faces.

2. A multi-section mattress or mattress overlay as recited in claim 1 wherein said seam includes a first bordering portion of said third face bonded to a second bordering portion of said first face.

3. A multi-section mattress or mattress overlay as recited in claim 1 wherein said seam includes a first bordering portion of said third face bonded to a second bordering portion of said first face by a radio frequency sealing bar.

4. A multi-section mattress or mattress overlay as recited in claim 1 wherein at least some of said cell walls are perforated to permit air circulation between cells.

5. A multi-section mattress or mattress overlay as recited in claim 1 wherein said first facing sheet is bonded to said second core face and a third facing sheet is bonded to said first core face, and wherein said second facing sheet is bonded to said fourth core face and a fourth facing sheet is bonded to said third core face, and wherein at least one of said facing sheets on each said section is perforated to permit air circulation into and out of each section.

6. A multi-section mattress or mattress overlay as recited in claim 5 wherein at least said second and fourth core faces are planarized prior to having said first and second facing sheets respectively bonded thereto.

7. A multi-section mattress or mattress overlay as recited in claim 1 wherein said first facing sheet is bonded to said second core face and a third facing sheet is bonded to said first core face, and wherein said second facing sheet is bonded to said fourth core face and a fourth facing sheet is bonded to said third core face, and wherein at least said first and third core faces are planarized prior to having said third and fourth facing sheets respectively bonded thereto to provide smooth sleeping surfaces on each section.

8. A multi-section mattress or mattress overlay, comprising:

a first generally rectangular section made from a first honeycomb core having a first core face and a second core face, said first core having a first facing sheet bonded to one of said first and second core faces;

a second generally rectangular section made from a second honeycomb core having a third core face and a fourth core face, said second core having a second facing sheet bonded to one of said third and fourth core faces, said second section being positioned with one side thereof immediately adjacent an opposing side of said first section; and means forming a seam joining said first and second sections together along the entire lengths of said one side and said opposing side, said seam being formed by bonding a planar portion of said first face extending along said one side to a portion of said third face extending along said opposing side in a stacked relationship, and by orienting the bonded portions of said first and third faces such that they extend away from a plane including said first and third faces and toward a plane including said second and fourth faces.

9. A multi-section mattress or mattress overlay as recited in claim 8 wherein said seam includes a first bordering portion of said third face bonded to a second bordering portion of said first face.

10. A multi-section mattress or mattress overlay as recited in claim 8 wherein said seam includes a first bordering portion of said third face bonded to a second bordering portion of said first face by a radio frequency sealing bar.

11. A multi-section mattress or mattress overlay as recited in claim 8 wherein at least some of said cell walls are perforated to permit air circulation between cells.

12. A multi-section mattress or mattress overlay as recited in claim 8 wherein said first facing sheet is bonded to said second core face and a third facing sheet is bonded to said first core face, and wherein said second facing sheet is bonded to said fourth core face and a fourth facing sheet is bonded to said third core face, and wherein at least one of said facing sheets on each said section is perforated to permit air circulation into and out of each section.

13. A multi-section mattress or mattress overlay as recited in claim 12 wherein at least said second and fourth core faces are planarized prior to having said first and second facing sheets respectively bonded thereto.

14. A multi-section mattress or mattress overlay as recited in claim 8 wherein said first facing sheet is bonded to said second core face and a third facing sheet is bonded to said first core face, and wherein said second facing sheet is bonded to said fourth core face and a fourth facing sheet is bonded to said third core face, and wherein at least said first and third core faces are planarized prior to having said third and fourth facing sheets respectively bonded thereto to provide smooth sleeping surfaces on each section.

15. A method of making a multi-section mattress or mattress overlay, comprising:

forming a first generally rectangular section from a first honeycomb core having a first core face and a second core face;

forming a second generally rectangular section from a second honeycomb core having a third core face and a fourth core face;

laying said second section over said first section with said third core face resting upon said first core face;

compression bonding a first portion of said second section extending along one side thereof to a second portion of said first section lying beneath said first portion and extending along a side of said second portion aligned with said one side of said first portion to form a seam; and rotating said second section about said seam and into a position lying adjacent said first section and substantially coplanar therewith and such that the bonded portions of said first and second sections extend away from a plane including said first and third core faces and toward a plane including said second and fourth core faces.

16. A method of making a multi-section mattress or mattress overlay as recited in claim 15 wherein said first honeycomb core is formed of undulated strips of resilient thermoplastic material, thermal compression bonded together and expanded to form cell walls defining a first plurality of contiguous regularly shaped cells extending between said first and second core faces.

17. A method of making a multi-section mattress or mattress overlay as recited in claim 16 and further comprising bonding a first facing sheet to one of said first and second core faces.

18. A method of making a multi-section mattress or mattress overlay as recited in claim 16 wherein said second honeycomb core is formed of undulated strips of resilient thermoplastic material, thermal compression bonded together and expanded to form cell walls defining a second plurality of contiguous regularly shaped cells extending between said third and fourth core faces.

19. A method of making a multi-section mattress or mattress overlay as recited in claim 18 and further comprising bonding a second facing sheet to one of said third and fourth core faces.

20. A method of making a multi-section mattress or mattress overlay as recited in claim 19 and further comprising planarizing said core faces before said first and second facing sheets are bonded thereto.

* * * * *